US007426840B2

(12) United States Patent
Sytz

(10) Patent No.: US 7,426,840 B2
(45) Date of Patent: Sep. 23, 2008

(54) SPACER FABRIC WITH INTEGRAL, EXPOSED LOOPS AND METHOD OF MAKING

(76) Inventor: Ronald M. Sytz, P.O. Box 3736, Gastonia, NC (US) 28054-0020

( * ) Notice: Subject to any disclaimer, the term of this patent is extended or adjusted under 35 U.S.C. 154(b) by 0 days.

(21) Appl. No.: 11/649,431

(22) Filed: Jan. 4, 2007

(65) Prior Publication Data

US 2008/0163650 A1 Jul. 10, 2008

(51) Int. Cl.
*D04B 7/30* (2006.01)

(52) U.S. Cl. ..... 66/196

(58) Field of Classification Search ..... 66/191, 66/194, 190, 193

See application file for complete search history.

(56) References Cited

U.S. PATENT DOCUMENTS 5,385,036 A 1/1995 Spillane
5,413,837 A 5/1995 Rock et al.
5,422,153 A * 6/1995 Miyamoto ..... 66/202
5,783,277 A 7/1998 Rock et al.
5,817,391 A 10/1998 Rock et al.
6,105,401 A * 8/2000 Chadeyron et al. ..... 66/195
6,116,059 A 9/2000 Rock et al.
6,151,928 A * 11/2000 Anyon et al. ..... 66/196
6,156,406 A 12/2000 Rock et al.
6,199,410 B1 3/2001 Rock et al.
6,634,190 B2 * 10/2003 Didier-Laurent ..... 66/196
6,644,070 B2 11/2003 Ikenaga et al.
6,735,145 B1 5/2004 Atallah et al.
6,755,052 B1 6/2004 Sytz
6,758,068 B2 7/2004 Shirasaki et al.
6,779,369 B2 8/2004 Shepherd

* cited by examiner

*Primary Examiner*—Danny Worrell
(74) *Attorney, Agent, or Firm*—Triangle Patents, PLLC

(57) ABSTRACT

A three dimensional spacer fabric including a unitary, integral spacer fabric formed from interknitted layers, including a first layer of fabric, a second interconnecting layer and a third layer of fabric, wherein the third layer further includes loops of yarn protruding outward with loop apex points providing a looped surface on one side of the fabric for functioning with hook-and-loop type fasteners, and methods of making said fabric.

16 Claims, 1 Drawing Sheet

SPACER FABRIC WITH INTEGRAL, EXPOSED LOOPS AND METHOD OF MAKING

BACKGROUND OF THE INVENTION

1. Field of the Invention

The present invention relates generally to knitted spacer fabric and, more particularly, to three dimensional knitted spacer fabric having integral, exposed loops for hook-and-loop fastener functionality on a predetermined surface of the fabric.

2. Description of the Relevant Art

Prior art includes spacer fabrics and hook-and-loop type fasteners. However, hook-and-loop type fasteners are formed in or cut down to strips of relatively narrow widths and require affixation to fabric, material or other surfaces. Typically this affixation is by adhesive or mechanical stitching or sewing, in the case of fabrics in particular. Delamination or detachment of the affixed sides of the hook-and-loop type fasteners is a common failure mechanism. Additionally, typically the looped side of the hook-and-loop type fasteners deteriorates or wears from use and requires replacement of the strip because the hooked side pulls at this looped surface and degrades the loops. Furthermore, spacer fabric use within the prior art and looped fabric are separate, independent fabrics that are not known to be integrated or formed within the same fabric body; there is simply no known method for forming such an integrated fabric that provides all of the benefits of a spacer fabric with those of a looped fabric. As separate fabrics, the spacer fabric has many applications. The second fabric that is a fabric that has loops knit into the fabric, including brushed or napped loops that provide a soft fleece surface; this surface is used in different applications, including using the fabric as soft surface inside of a garment, as a insulating surface inside of a garment, as a soft surface inside of a sport brace, as a soft surface needed in any application. Additionally, the loops of this second type of fabric may be left unbrushed or as natural loops, and in this case these loops are usually using a heavier denier per filament of yarn and are typically known as the loop fabric in a hook-and-loop fastener combination such as the commercially available VELCRO. These loops function to provide resistance for the hook not to pull loose, as is known in the art. Thus, there is a longstanding and unmet need to combine these two fabric constructions into one integrated fabric. Again, currently there is no known way of making these two unique fabric constructions into one integrated fabric during the same fabric-forming or knitting process. The current combination of these fabrics is only done by laminating the two fabrics together. During the lamination of two fabrics together, the properties of each fabric are changed and diminished due to the adhesion or lamination of the fabrics to each other. This adhesion also affects the inherent stretch in the fabrics and therefore changes their individual and collective properties; it also affects the breatheability of combined fabrics by using adhesives or film. Therefore there continues to be a need to make this fabric during one process.

Examples of relevant art patent documents include the following:

U.S. Pat. No. 5,817,391, "Three-dimensional knit spacer fabric for bed pads", Rock et al., provides a three dimensional knit or woven fabric with a first layer and a second layer spaced from each other by an interconnecting resilient yarn that is suitable for use in bed pads.

In U.S. Pat. No. 6,116,059, "Three-dimensional sport medical support spacer fabric", (Rock et al.), is a three dimensional knit spacer fabric with a hydrophilic first layer, an abrasion resistant second layer spaced with a resilient yarn.

In U.S. Pat. No. 6,199,410, "Double face warp knit fabric with two-side effect", Rock et al. describe a method for making fabric with a velour on one side and a velvet on the other. The two faces may be of different colors.

U.S. Pat. No. 6,755,052, "Knitted stretch spacer material and method of making", (Sytz) is a knitted spacer material with increased stretch and compression resistance; decreased weight and improved comfort and shape.

In U.S. Pat. No. 5,385,036, "Warp knitted textile spacer fabric, method of producing same, and products produced therefrom" (Spillane et al.) a warp knitted textile spacer fabric is comprised of front and back fabric layers interconnected with monofilament pile yarns. The fabric resists compression and relative shear of the two fabric layers.

In U.S. Pat. No. 5,413,837, "Three dimensional knit fabric", Rock et al. describe a three-dimensional knit fabric that is permeable to water vapor but impermeable to liquid water.

U.S. Pat. No. 5,783,277, "Three-dimensional knit spacer fabric for footwear and outerwear" (Rock et al.) provides an integrated knit spacer fabric with two fabric layers, both of which are made from hydrophilic fibers.

In U.S. Pat. No. 6,156,406, "Three-dimensional high-low bulk spacer fabric" (Rock et al.) a three dimensional knit fabric with two layers is connected with yarn. In some sections the yarn is perpendicular to the layers while in others it is set at an angle to the layers. The sections with the yarn set at an angle to the layers expand upon application of a pressurized air source.

U.S. Pat. No. 6,644,070 "Three dimensional fabric for seat", (Ikenaga et al.) is a three dimensional fabric with increased comfort and resistance to compression that make it useful as a seat cover.

In U.S. Pat. No. 6,758,068, "Three dimensionally structured warp knitted fabric", Shirasaki et al. describe an improved three-dimensional warp knitted fabric. The improvements are achieved by using connecting yarn controlling yarns that limit the deterioration of the fabric.

U.S. Pat. No. 5,735,145, "Weft knit wicking fabric and method of making same" (Pernick) is a multilayer fabric of two hydrophilic layers connected by spacer yarns.

U.S. Pat. No. 6,779,369, "Weft knitted spacer fabrics", (Shepherd) provides a method of producing a jacquard patterned, weft knitted three dimensional fabric on a double jersey circular knitting machine.

Thus there remains a need in the field for a fabric having integral, exposed loops on a surface that function as hook-and-loop type fastener for the looped side to resolve the typical failures modes present in the relevant art.

SUMMARY OF THE INVENTION

A first aspect of the present invention is to provide a three dimensional spacer fabric including a unitary, integral spacer fabric formed from interknitted layers, including a first layer of fabric, a second interconnecting layer and a third layer of fabric, wherein the third layer further includes loops of yarn protruding outward with loop apex points providing a looped surface on one side of the fabric.

A second aspect of the present invention is to provide a unitary, integral three dimensional spacer fabric formed from interknitted layers, including a first layer of fabric, a second interconnecting layer and a third layer of fabric, wherein the third layer further includes integral, exposed loops of yarn that provide a looped surface on one side of the fabric.

Another aspect of the invention provides a method of making a three dimensional spacer fabric including the steps of knitting a spacer fabric, selectively dropping knitted loops, and exposing the loops on one surface, thereby providing a unitary, integral spacer fabric formed from interknitted layers, including a first layer of fabric, a second interconnecting layer and a third layer of fabric, wherein the third layer further includes integral, exposed loops of yarn that provide a looped surface on one side of the fabric.

Thus, the present invention provides a fabric having integral, exposed loops on a surface that function as the looped side for a hook-and-loop type fastener without requiring affixation independent of the fabric construction, thereby eliminating detachment and wear problems universally present in the relevant art.

These and other aspects of the present invention will become apparent to those skilled in the art after a reading of the following description of the preferred embodiment when considered with the drawings, as they support the claimed invention.

DETAILED DESCRIPTION

Figure 1:
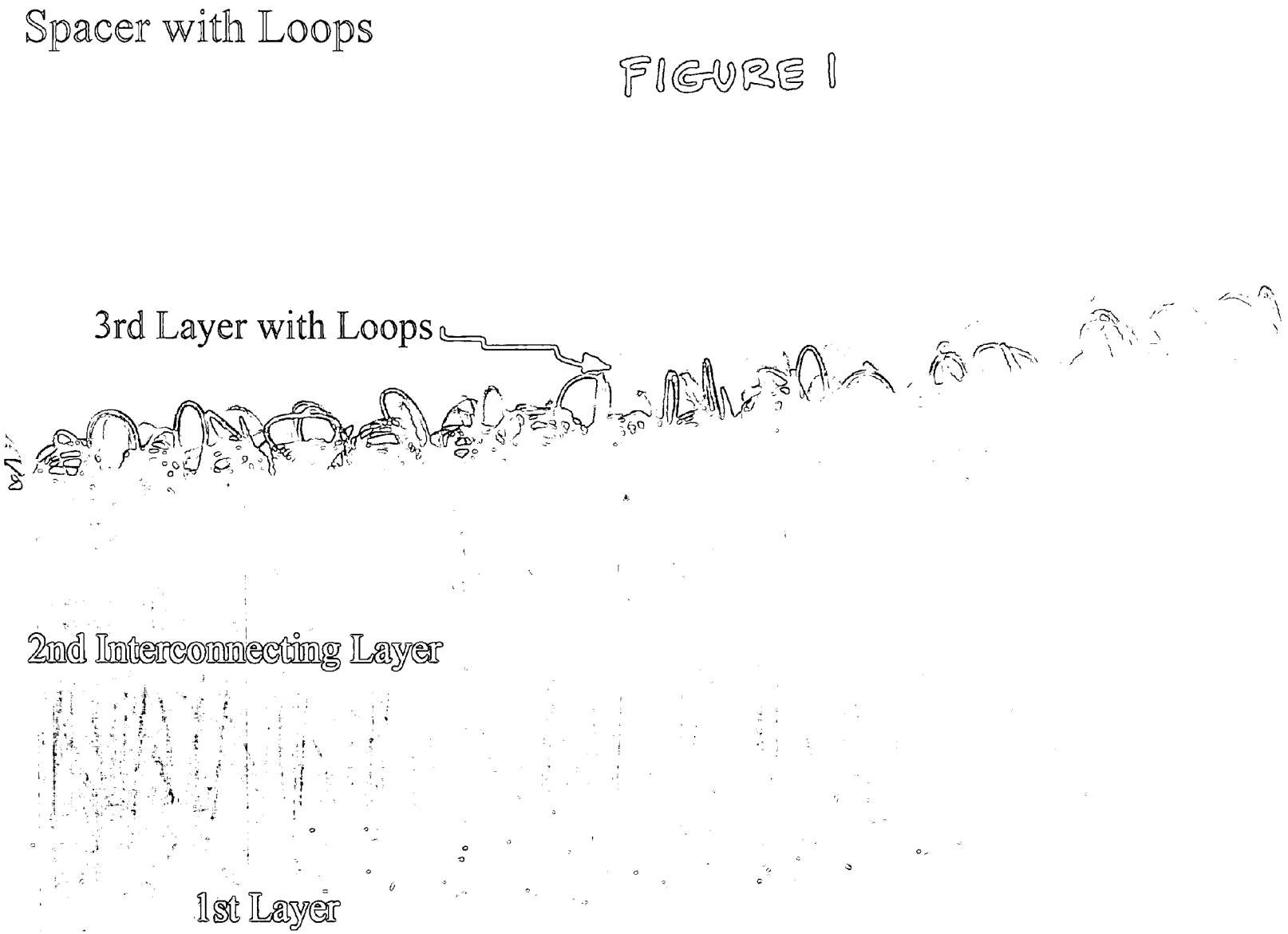
FIG. 1 is a cross-sectional view of the three dimensional unitary, integral spacer fabric with integral, exposed loops according to the present invention.

In the following description, it is to be understood that such terms as "forward," "rearward," "front," "back," "right," "left," "upwardly," "downwardly," and the like are words of convenience and are not to be construed as limiting terms.

The present invention provides provide a three dimensional spacer fabric including a unitary, integral spacer fabric formed from interknitted layers, including a first layer of fabric, a second interconnecting layer and a third layer of fabric, wherein the third layer further includes loops of yarn protruding outward with loop apex points providing a looped surface on one side of the fabric. More particularly, the unitary, integral three dimensional spacer fabric is formed from interknitted layers, including a first layer of fabric, a second interconnecting layer and a third layer of fabric, wherein the third layer further includes integral, exposed loops of yarn that provide a looped surface on one side of the fabric. These integral, exposed loops function as the looped side of hook-and-loop type fasteners without requiring attachment or affixation to a garment, since they are integral to the fabric that is used as the garment. Other non-garment applications are within the scope of the present invention as claimed.

Additionally, the present invention provides a method of making a three dimensional spacer fabric including the steps of knitting a spacer fabric, selectively dropping knitted loops, and exposing the loops on one surface, thereby providing a unitary, integral spacer fabric formed from interknitted layers, including a first layer of fabric, a second interconnecting layer and a third layer of fabric, wherein the third layer further includes integral, exposed loops of yarn that provide a looped surface on one side of the fabric.

Referring now to the drawings in general, the illustrations are for the purpose of describing a preferred embodiment of the invention and are not intended to limit the invention thereto. As best seen in FIG. 1, a cross-section of the fabric is shown. FIG. 1 shows a preferred embodiment of the thee dimensional spacer fabric of the present invention having a first layer including a back surface, a second layer that is an interconnecting layer that provides the spaced-apart distance between the fabric surfaces, and a third layer including integrally formed, exposed loops including a face surface of the fabric.

Functionally, the unitary, integral construction of the three dimensional spacer fabric with integral, exposed loops of the present invention provide a solution to problems in the prior art by integrating two important features and functions of otherwise separate fabrics into a single embodiment that is not subject to delamination or detachment, as described in the background. In considering the spacer fabric as a preferred embodiment, it uniquely provides two outer layers having surfaces and thickness interconnectedly and integratedly formed in a novel knitting process that forms the middle layer or interconnecting layer between those two outer layers and their corresponding surfaces. It is not possible to achieve the functionality and properties of the fabric of the present invention by laminating two separate fabrics, or otherwise attaching or connecting them after the initial fabric formation process is completed; that would merely produce a fabric having similar thickness and surface characteristics at best, but would introduce the problems of delamination, permeability differences and non-uniformities and eliminated the benefits of the final fabric and the efficiencies of using the method of manufacture as well.

In a preferred embodiment, the spacer fabric middle layer or interconnecting layer is formed from monofilament yarns for providing compression resistance when force is applied to the fabric surface, and for providing resilience for rebound to initial or substantially initial fabric thickness following compression or impact on the surface.

In another preferred embodiment, the spacer fabric middle layer or interconnecting layer is formed from multifilament yarns for providing reduced permeability of the overall fabric. Specific yarn properties are selected based upon the final fabric properties and application desired. By way of example and not limitation, spacer fabrics are currently used in many varied types of applications, from industrial to garment or apparel applications. Typically, spacer fabrics are used to provide additional functionality not possible with a single fabric type. Some common application functions for spacer fabrics include insulating, breathability-enhancing, supporting, stabilizing and shaping. Again, by way of example and not limitation, spacer fabrics are used in athletic brace applications in place of neoprene to provide breathability as well as support and conformability. In another example, bra cups use spacer fabric because it provides shape and support in place of foam inserts, which shift or lose placement and require additional garment fabrication steps to create pockets or placement of same. The spacer fabric of the present invention has applications in most of the same applications as traditional spacer fabric, with the added benefit and functionality of including loop side functionality for hook-and-loop type fasteners at any position on the fabric surface having integral, exposed loops thereon.

The present invention method for forming a three dimensional knitted spacer fabric having three unitarily and integrally formed layers with two spaced-apart surfaces, at least one of which has integrally formed, exposed loops thereon, includes the following steps.

Preferably, the first steps during the knitting process form or create the interconnecting or middle spacer layer (also referred to herein as layer 2), which does not have any exposed surfaces. The knitting steps for forming this layer including tucking a layer 2 yarn onto both dial and cylinder needles of a knitting machine. The next step is to knit the first layer that does not include exposed loops (also referred to herein as layer 1); this layer provides a flat side or surface of the three dimensional spacer fabric of the present invention. This layer 1 formation is done by knitting this layer on the dial-only needles of the same knitting machine as used for layer 2 formation. During this knitting step, if additional stretch beyond what is provided according to the mechanical structure of the knitted fabric is required in the overall fabric, then preferably an elastomeric yarn, such as spandex or the yarn commercially known as LYCRA, is knitted into the needles at the same time. The next step knits a binding yarn onto the cylinder needles. This yarn is knit in order to hold the loop yarns of the face side of the third layer (also referred to herein as layer 3) into the fabric during the next steps of the fabric formation process. This yarn may also be knitted with an elastomeric yarn or yarn component to impart additional stretch into the fabric beyond what is provided by the mechanical stretch of the knitted structure alone. During this step the knitting action forms the loop yarn onto the other half of the cylinder needles of the machine without casting off the previous stitch of the cylinder yarn from the prior steps. After the loop yarn is knitted into the needles, then the loop yarns are cast off the needles without releasing the binding yarn. This completes the knitting of one course of the unitary, integrally formed three dimensional spacer fabric having integrally formed, exposed loops on one surface of the fabric. This process is repeated around the knitting machine as many times as possible based upon the design of the machine being used and the fabric size required.

machine diameter and cut (needles per inch) can be specified to get the proper width or coarseness of the fabric depending upon the application and properties required.

Regarding other examples for combinations of yarns and uses of the three dimensional spacer fabric with integrally formed, exposed loops of the present invention, the yarns depend upon the fabric application or function. Where additional processing of the looped side or surface of the fabric is performed or expected, then the following yarn combinations are preferably used for napping or brushing loops, such as shown in Table 1 below. This is used to replace fabrics that may be laminated to neoprene and the like in order to provide a soft brushed surface on one side. The napping or brushing of the loops is optionally performed as another step after the fabric formation or knitting of the fabric is completed and the fabric is removed from the knitting machine.

Note that preferably there is a binding yarn incorporated within the layer 3 or integral, exposed loop layer of the three dimensional spacer fabric of the present invention. This binding yarn is typically of the same type of fiber as the loop yarn yet may be different if needed to provide a different look or utilization. The stitch knitting the binding yarn may also include an elastomeric yarn to enhance the stretch and recovery of the fabric, or not include it where the desire is to create a fabric with minimal stretch.

TABLE 1

| LAYER/SIDE | YARN TYPE | FUNCTIONALITY |
|---|---|---|
| Flat side Layer 1 | nylon & elastomeric | Nylon for abrasion resistance |
| Flat side Layer 1 | nylon only | Nylon for abrasion resistance |
| Flat side Layer 1 | poly & elastomeric | Poly for wicking |
| Flat side Layer 1 | poly only | Poly for wicking |
| Flat side Layer 1 | Aramid & elastomeric | Aramid for fire resistance |
| Flat side Layer 1 | Aramid only | Aramid for fire resistance |
| Flat side Layer 1 | polypropylene (PP) | PP for wicking, abrasion, stain resist |
| Flat side Layer 1 | polypropylene only | PP for wicking |
| Middle Layer 2 | monofilament any fiber | compression resistance |
| Middle Layer 2 | multifilament any fiber | wicking or wind resistance |
| Middle Layer 2 | Aramid | Aramid for fire resistance |
| Middle Layer 2 | combination | to provide each yarn's specific benefits |
| Loop Layer 3 | monofilament any fiber | creating a stiff, erect loop structure |
| Loop Layer 3 | multifilament any fiber | fornapping/brushing to create a soft fleece surface that can be used next to skin if desired or to be used as an insulation layer |
| Loop Layer 3 | Aramid | Aramid for Fire Resistance |
| Loop Layer 3 | combination | to provide each yarn's specific benefits. |

Variations on the knitting sequence may be used without departing from the scope of the present invention. By way of example, changing the order of the sequence, reversing the pattern such that the loops are formed on the dial needles side instead of on the cylinder side.

The fabric of the present invention combines the benefits of the otherwise two separate types of fabric into a single, integral fabric. As will be appreciated by one of ordinary skill in the art, the yarns used to form the fabric are selected from a variety of yarn types and sizes. These types and sizes of yarns can be changed, modified, and/or combined, depending upon the fabric properties and application or usage. By way of example and not limitation, yarn types are selected from polyamide or nylon, polyester, polypropylene, aramid, and other performance yarns, natural fiber yarns, and combination thereof. Again, these selections and combinations will necessarily vary depending upon the fabric application. The Certain modifications and improvements will occur to those skilled in the art upon a reading of the foregoing description. The above mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the following claims.

What is claimed is:

1. A three dimensional spacer fabric comprising a unitary, integral spacer fabric formed from interknitted layers, including a first layer of fabric, a second interconnecting layer and a third layer of fabric, wherein, the third layer further includes a binding yarn incorporated within the third layer, and wherein the third layer further includes a loop yarn, the loop yarn forming loops of yarn protruding outward with loop apex points providing a looped surface on one side of the fabric, wherein the loop yarn and the binding yarn each form a stitch at substantially the same location.

2. The fabric of claim 1, wherein the first layer includes at least one performance yarn for providing predetermined fabric properties.

3. The fabric of claim 2, wherein the at least one performance yarn is selected from cotton, polyester, nylon, aramid, and combinations thereof.

4. The fabric of claim 1, wherein at least one layer includes an elastomeric yarn component.

5. The fabric of claim 4, wherein the first and third layer includes an elastomeric yarn component.

6. The fabric of claim 1, wherein the first layer is treated to provide hydrophilic properties for promoting moisture wicking through the fabric away from the outer surface of the first layer.

7. The fabric of claim 1, wherein the second interconnecting layer of fabric is a monofilament, thereby providing increased fabric permeability, compression resistance, and resiliency.

8. The fabric of claim 1, wherein the second interconnecting layer of fabric includes a multifilament yarn to decrease fabric permeability.

9. The fabric of claim 1, wherein the layers are formed from yarns having different denier.

10. The fabric of claim 9, wherein the yarns range between about 20 and about 1000 denier.

11. The fabric of claim 1, wherein the fabric is knitted on cut machines between about 9 cut and about 42 cut (varies coarseness of fabric for different end use applications).

12. The fabric of claim 1, wherein the third layer of fabric is made using a unique knitting technique that creates loops on the outside of the fabric.

13. A three dimensional spacer fabric comprising a unitary, integral spacer fabric formed from interknitted layers, including a first layer of fabric, a second interconnecting layer and a third layer of fabric, wherein the third layer further includes a binding yarn incorporated within the third layer and wherein the third layer further includes a loop yarn, the loop yarn forming integral, exposed loops of yarn that provide a looped surface on one side of the fabric, wherein the loop yarn and the binding yarn each form a stitch at substantially the same location.

14. A method of making a three dimensional spacer, fabric comprising the steps of:

a. Knitting a spacer fabric;

b. Selectively dropping knitted loops;

c. Exposing the loops on one surface, thereby providing a unitary, integral spacer fabric formed from interknitted layers, including a first layer of fabric, a sccond interconnecting layer and a third layer of fabric, wherein the third layer further includes a binding yarn incorporated within the third layer and wherein the third layer further includes a loop yarn, the loop yarn forming integral, exposed loops of yarn that provide a looped surface on one side of the fabric, wherein the loop yarn and the binding yarn each form a stitch at substantially the same location.

15. The fabric of claim 1, wherein the loops of yarn further provide releasable connectivity to a hook fastener.

16. The fabric of claim 1, wherein the third layer maintains structural integrity when the loops of yarn are napped and brushed.

* * * * *